United States Patent [19]

Stahlecker

[11] 3,975,895

[45] Aug. 24, 1976

[54] OPEN-END SPINNING MACHINE WITH MEANS FOR SUPPLYING A SLIVER

[75] Inventor: Fritz Stahlecker, Bad Uberkingen, Germany

[73] Assignees: Fritz Stahlecker; Hans Stahlecker, both of Germany

[22] Filed: Mar. 7, 1975

[21] Appl. No.: 556,438

[30] Foreign Application Priority Data

Apr. 11, 1974 Germany ..... 2417736

[52] U.S. Cl. ..... 57/58.95; 57/56

[51] Int. Cl.[2] ..... D01H 1/12; D01H 11/00

[58] Field of Search ..... 57/50, 56, 58.89–58.95

[56] References Cited

UNITED STATES PATENTS 3,884,028 5/1975 Stahlecker et al. ..... 57/56

*Primary Examiner*—John Petrakes

*Attorney, Agent, or Firm*—Craig & Antonelli

[57] ABSTRACT

An open-end spinning machine contains fiber guide surfaces, which are associated to the opener roll, between the means for supplying a sliver to an opener roll and a fiber supply channel leading to a spinning rotor. These fiber guide surfaces contain a removal opening, through which the impurities from the open sliver are removed. Inserted in this removal opening, which begins directly at the means for supplying the sliver, is a conveyor belt, which replaces a portion of the fiber guide surfaces. This increases the cleaning effect and prevents air from infiltrating.

14 Claims, 1 Drawing Figure

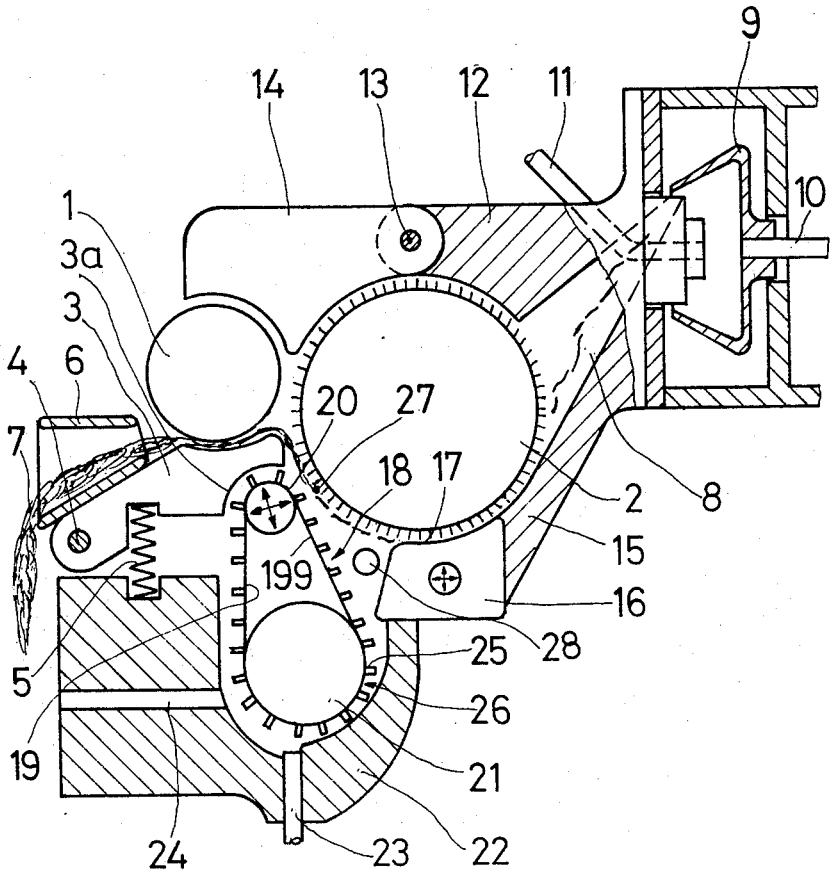
9
14
13
12
11
10
1
3a
3
4
6
7
20
27
18
17
2
8
15
199
Q
16
28
25
5
26
19
21
24
23
22

OPEN-END SPINNING MACHINE WITH MEANS FOR SUPPLYING A SLIVER

The present invention relates to an open-end spinning machine having means for supplying a sliver to an opener roll which is followed by a fiber supply channel leading to a spinning rotor, with fiber guide surfaces having a removal opening being associated to the opener roll in the area between the means for supplying the sliver and the fiber supply channel.

It is known practice to also utilize the principle of cleaning an opened sliver, which has been in common use for carding for a long time, one open-end spinning machines. With this design, a removal opening is provided in the area of a fiber guide surface located between a pressure undercasing and a fiber supply channel, with the removal opening being connected directly to an exhausting line for transporting away the impurities removed from the fibers. Since in open-end spinning machines the fibers are transported to the spinning rotor primarily by means of an air stream produced by an underpressure, exhausting the impurities from the removal opening is annoying, as this can impede the transport of the fibers. In order to provide a solution to this problem, in a different known design the exhausting means are only switched on intermittently, with the exhausting opening being closed during the exhausting operation. While this does not impede the transport of the fibers, impurities can reach the spinning rotor during the exhausting operation, which would impair the spinning conditions and could possibly result in a premature thread break.

It is the object of the present invention to design an open-end spinning machine of the type mentioned at the outset in such a manner as to permit continuous cleaning of the supplied and opened sliver without impeding or impairing the other spinning conditions. According to the present invention, this object is solved in that a conveyor belt is inserted in the removal opening and serves as a fiber guide surface moving in the direction of travel of the fibers and forming a collection area for the impurities removed from the fibers together with an end wall of this removal opening.

This development permits effective cleaning of the sliver with continuous removal of the impurities, without any danger of the area up to the opener roll being affected thereby. As was surprisingly found, the removal edge which is directed against the direction of travel of the fibers and toward the opener roll in the known designs can be eliminated.

In an advantageous embodiment of the invention, the conveyor belt leads from the collection area to a removal opening. This results in the advantage that pneumatic removal of the impurities from the spinning machine is also possible, without any danger of these exhausting means affecting the area of the opener roll.

In an especially advantageous embodiment of the invention, the conveyor belt directly follows a pressure member which, together with a supply roller, forms the means for supplying the sliver. In this embodiment, the fiber tuft offered to the opener roll by the supply roller and the pressure member is supported on the side facing away from the opener roll, which is advantageous with respect to both opening and cleaning. It was found that there is support in the area of the fiber tuft even when the conveyor belt does not even touch the fiber tuft.

The above discussed and other objects, features and advantages of the present invention will become more apparent from the following description thereof, when taken in connection with the accompanying drawing of an embodiment of the present invention.

Referring now to the drawing, wherein like reference numerals designate like parts throughout the several views, a portion of an open-end spinning machine in shown, in which a sliver is opened and supplied to a spinning rotor in the form of individual fibers.

Sliver 7 is offered to a supply roller 1, which operates conjointly with a pressure undercasing which is acted upon by the pressure of a spring 5 and which can be pivoted about axle 4, via an inlet funnel 6. The inlet funnel can be designed as a single component together with the pressure undercasing. Sliver 7 is offered to an opener roll 2, rotating at very high speed, in the form of a fiber tuft 27 via supply roller 1 and pressure undercasing 3. The fibers are separated by clothed opener roll 2 and then supplied through a fiber supply channel 8 to a spinning rotor 9, whose shaft 10 is mounted in an unillustrated manner. The spun thread is drawn off from the spinning rotor through a fiber chanel 11. The upper areas of supply roller 1 and opener roll 2 are covered by a sealing lid 14, which can be pivoted about axle 13, in order to prevent air from infiltrating and contamination by fly.

Viewed in the direction of travel of the fibers, pressure undercasing 3 is followed by a removal opening 18, which extends at an angle of approximately 90°. In the direction of travel of the fibers, removal opening 18 is defined by a wall, which is formed by an interchangeable and/or adjustable insert 16. In addition, insert 16 also forms a fiber guide surface 17, whose distance from opener roll 2 can be altered in order to influence the air streams which are present there.

Inserted into removal opening 18 is a conveyor belt 19, which forms a fiber guiding surface at least in that area which directly follows pressure undercasing 3 and which supports fiber tuft 27 to a greater or lesser degree. Conveyor belt 19, which extends about a drive roller or drive shaft 21 and a bolt 20, extends generally tangential to opener roll 2 in the area directly following pressure undercasing 3, with the driving direction being selected in such a manner as to provide transport in the normal direction of travel of the fibers.

Bolt 20 and drive roller or drive shaft 21 are at least partially surrounded by pressure undercasing 3, having a recess 3*a*, and housing 22, so that this area is sealed off relatively well from the area of opener roll 2. This largely prevents the infiltration of air in the area of a collecting chamber for impurities formed between the end wall of insert 16 and drawn track 19*a* of conveyor belt 19. Air supply means 28, which open into the collecting chamber, ensure a sufficient flow of air in the area of fiber guide surface 17 and fiber supply channel 8. It is practical for air supply means 28 to be designed in such a manner as to permit control of the incoming air.

At a distance from the collecting chamber, conveyor belt 19 is followed by exhausting means 23 in the area of drive shaft 21; exhausting means 23 exhaust the impurities and advance them to central removal means. It is practical for conveyor belt 19 to have ridges 25, which form chambers 26 or similar elements on its outer surface, in which the impurities can be collected. Moreover, these chambers also provide the advantage that they further improve the seal between exhausting means 23 and the collecting chamber in the area of removal opening 18. In order to provide a sufficient stream of air for exhausting the impurities from conveyor belt 19, there is also a supply air channel 24, which follows exhausting means 23 as viewed in the direction of rotation, in the area of drive shaft 21. The housing between exhausting means 23 and supply air channel 24 is designed in such a manner as to provide a sufficient stream of air.

It is practical for bolt 20, which deflects the conveyor belt, to be designed as a stay bolt, which can be adjusted at least slightly to all sides, with this adjusting possibility being represented by the illustrated arrows. This permits conveyor belt 19 to be arranged at preselectable distances from both pressure undercasing 3 and opener roll 2 in the area of pressure undercasing 3, permitting adaptation to differing staple lengths.

Practical trials have shown that even the employment of a smooth belt as conveyor belt 19 provides quite good results, which can be improved through the employment of a belt whose outer surface is divided into pockets, chambers or similar means. Surprisingly, it was also found that a removal edge or similar means, which extend into the path of travel of the fibers, are not necessary. These removal edges, which were previously necessary for carding and with the cleaning means intended for open-end spinning machines, can therefore be eliminated. These were parts which were subject to a high degree of wear.

Obviously, many modifications and variations of the present invention are possible in the light of the above teachings. It should therefore be understood that within the scope of the appended claims, the invention may be practiced otherwise than as specifically described.

Having thus fully disclosed my invention, what I claim is:

1. An open-end spinning machine comprising:

a spinning rotor, an opener roll, a fiber supply channel leading from said opener roll to the spinning rotor, means for supplying a sliver to the opener roll, fiber guide surfaces having a removal opening associated to said opener roll in the area between said means for supplying the sliver and said fiber supply channel, and a conveyor belt arranged in said removal opening and serving as a portion of said fiber guide surfaces moving in the direction of travel of the fibers and forming a collection area for removed impurities together with an end wall of said removal opening, said conveyor belt extending along and serving as fiber guide surface for a substantial portion of the travel path of said fibers at said opening roll.

2. The open-end spinning machine according to claim 1, in which said conveyor belt continues on from said collection area to an exhausting opening.

3. The open-end spinning machine according to claim 2, in which a roller for said conveyor belt is arranged in the area of said collection chamber, said roller being surrounded by a housing and said exhaust opening being arranged in the area thereof.

4. The open-end spinning machine according to claim 3, in which a supply air opening directed toward said conveyor belt is arranged in the area of said exhausting opening.

5. The open-end spinning machine according to claim 1, in which said conveyor belt directly follows a pressure member which, together with a supply roller, forms said means for supplying the sliver.

6. The open-end spinning machine according to claim 5, in which, in the area of said pressure member, said conveyor belt is guided with means through which the clearance between said conveyor belt and said pressure member can be adjusted.

7. The open-end spinning machine according to claim 6, in which, in the area of said opener roll, said conveyor belt is guided with means through which the clearance between said conveyor belt and said opener roll can be adjusted.

8. The open-end spinning machine according to claim 5, in which a deflecting roller for said conveyor belt is arranged directly behind said pressure member, said deflecting roller being surrounded by a recess in said pressure member.

9. The open-end spinning machine according to claim 1, in which, in the area of said opener roll, said conveyor belt is guided with means through which the clearance between said conveyor belt and said opener roll can be adjusted.

10. The open-end spinning machine according to claim 1, in which, in the area following said pressure member, said conveyor belt is aligned generally tangential to said opener roll.

11. The open-end spinning machine according to claim 1, in which the end wall of said removal opening is formed by an interchangeable insert.

12. The open-end spinning machine according to claim 1, in which said end wall of said removal opening is formed by an adjustably mounted insert.

13. The open-end spinning machine according to claim 1, in which said conveyor belt has an outer surface which is divided into chambers or pockets.

14. The open-end spinning machine according to claim 1, in which said collection chamber opens into an air supply opening.

* * * * *